US008628033B2

(12) United States Patent
Boltersdorf

(10) Patent No.: US 8,628,033 B2
(45) Date of Patent: Jan. 14, 2014

(54) PULPER HAVING A SUPPLY CHAMBER AND A DISPLACEMENT CHAMBER

(76) Inventor: Hans-Joachim Boltersdorf, Brohl-Luetzing (DE)

( * ) Notice: Subject to any disclaimer, the term of this patent is extended or adjusted under 35 U.S.C. 154(b) by 0 days.

(21) Appl. No.: 13/698,344

(22) PCT Filed: Apr. 14, 2011

(86) PCT No.: PCT/DE2011/000398

§ 371 (c)(1),
(2), (4) Date: Nov. 28, 2012

(87) PCT Pub. No.: WO2011/144196

PCT Pub. Date: Nov. 24, 2011

(65) Prior Publication Data

US 2013/0075510 A1 Mar. 28, 2013

(30) Foreign Application Priority Data

May 19, 2010 (DE) ..... 10 2010 020 936
Sep. 17, 2010 (DE) ..... 10 2010 045 623
Sep. 27, 2010 (DE) ..... 10 2010 046 555

(51) Int. Cl.
*B02C 13/00* (2006.01)

(52) U.S. Cl.
USPC ..... 241/16; 241/20; 241/21; 241/24.1; 241/46.17; 241/68; 241/260.1

(58) Field of Classification Search
USPC ..... 241/16, 20, 21, 24.1, 46.17, 68, 260.1
See application file for complete search history.

(56) References Cited

U.S. PATENT DOCUMENTS

| | | | | |
|---|---|---|---|---|
| 2,912,174 | A * | 11/1959 | Bidwell | 241/15 |
| 4,848,674 | A * | 7/1989 | Hunter | 241/16 |
| 5,324,389 | A * | 6/1994 | Spencer | 162/4 |
| 5,645,229 | A * | 7/1997 | Spencer et al. | 241/20 |
| 5,681,429 | A * | 10/1997 | Vuorinen | 162/261 |
| 6,505,550 | B2 * | 1/2003 | Hamilton | 100/148 |
| 2006/0186235 | A1 * | 8/2006 | Kramer et al. | 241/21 |
| 2006/0208116 | A1 * | 9/2006 | Kofoed | 241/236 |
| 2009/0181126 | A1 * | 7/2009 | Wicking et al. | 426/61 |

OTHER PUBLICATIONS

International Search Report of PCT/DE2011/000398, date of mailing Sep. 5, 2011.

* cited by examiner

*Primary Examiner* — Dana Ross
*Assistant Examiner* — Onekki Jolly
(74) *Attorney, Agent, or Firm* — Collard & Roe, P.C.

(57) ABSTRACT

The invention relates to a pulper comprising a supply chamber (2) and a displacement chamber (3) for handling materials in an especially gentle manner, having a diameter between the supply chamber and the displacement chamber that is at most ⅓ of the diameter of the displacement chamber (3).

13 Claims, 5 Drawing Sheets

PULPER HAVING A SUPPLY CHAMBER AND A DISPLACEMENT CHAMBER

CROSS REFERENCE TO RELATED APPLICATIONS

Figure 1:
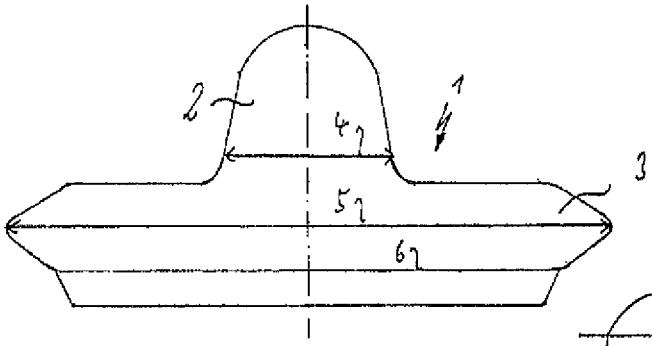

This application is the National Stage of PCT/DE2011/000398 filed on Apr. 14, 20011, which claims priority under 35 U.S.C. §119 German Application Nos. 10 2010 020 936.8 filed on May 19, 2010; 10 2010 045 623.3 filed on Sep. 17, 2010; and 10 2010 046 555.0 filed on Sep. 27, 2010, the disclosures of which are incorporated by reference. The international application under PCT article 21(2) was not published in English.

The invention relates to a pulper having a supply chamber and a displacement chamber. Pulpers usually have a pear-shaped reaction chamber. A supply chamber with a smaller diameter is provided in the upper region and a displacement chamber with a larger diameter is provided in the lower region, said displacement chamber usually comprising a perforated plate.

The material to be treated is fed to the pulper via a pulper entrance in the upper region of the pulper. The pure material is carried away beneath the perforated plate in the lower region of the pulper and the waste material is carried away above the perforated plate. Depending on the arrangement of the supply screw and the displacement spiral in the pulper, mixing processes arise in which freshly supplied material comes into contact with waste material.

The problem underlying the invention is to develop such a pulper.

This problem is solved with a generic pulper, wherein the diameter between the supply chamber and the displacement chamber amounts at most to ⅓ of the diameter of the displacement chamber.

The transition from the supply chamber to the displacement chamber is intentionally constituted very narrow in relation to the displacement chamber. A flow which leads to the handling of materials in an especially gentle manner thus arises in the pulper.

It is advantageous for the diameter to amount to at most ¼, preferably ⅓ and particularly preferably ⅙ of the diameter of the displacement chamber.

In order to design such pulpers, it is proposed that a neck reducing the diameter is disposed between the supply chamber and the displacement chamber. Instead of a neck, a shoulder can also be provided which acts on the flow conditions.

It is further proposed that the supply chamber comprises a supply screw leading centrally to the displacement chamber. This makes it possible to convey the supplied material centrally to the displacement chamber and for example a perforated plate.

It is therefore also proposed that the displacement chamber comprises a displacement spiral and a perforated plate. A directed movement of the pulp in the pulper can thus be brought about by the supply screw and the displacement spiral.

Moreover, it is advantageous if the displacement chamber comprises spheres above a perforated plate.

It is advantageous if the supply chamber comprises a pulper entrance and the displacement chamber comprises a pure material outlet, wherein a waste material outlet is disposed between the pulper entrance and the pure material outlet. The effect of this is that the waste material undergoes an intense circulation past the neck in a counter-flow to the supplied raw material, whilst the mixing losses can be kept small.

In practice, the supplied material, with a supply of water, is mixed in the supply chamber with the central supply screw, i.e. using a rotor screw, and is conveyed to the displacement chamber. In the displacement chamber, the supplied material is separated by means of a perforated plate and the waste material is carried away beneath the material supply plane out of the pulper, as far as possible before coming into contact with the supplied material. An intense circulation thus arises and the pulp is handled in an especially gentle manner.

If the waste material outlet is disposed on the supply chamber, friction of the waste material is again present in the displacement chamber and in the supply chamber, before the waste material leaves the pulper.

In order to minimise the backflow, the waste material outlet can be disposed tangential on the displacement chamber.

The supply chamber is usually disposed above the displacement chamber. In order to segregate heavy parts particularly effectively, it is proposed as an alternative that the supply chamber is disposed beneath the displacement chamber.

In order to generate a suitable material flow, especially in the case of a displacement chamber with a large radial extension, it is proposed that, in the displacement chamber, a displacement spiral extends over the radial extension of the displacement chamber.

An acceleration pulper is present when the diameter of the pulper in relation to the height of the pulper amounts to at least 1 and preferably more than 2.

The pulper becomes a sleeve pulper when it comprises a screen plate which is formed basket-like.

It is particularly advantageous if the screen plate comprises vertical regions.

The production is facilitated with an improved effect if the pulper comprises a displacement spiral, which at an upper end and at a lower end is connected to a central axis.

A particularly energy-saving guidance, of material is achieved if a groove with a width of several millimetres is provided between the screen plate segments.

An embodiment essential to the invention, even independently of the features described above, makes provision such that the supply chamber comprises a mixing chamber open to the top.

It is advantageous if the pulper is constituted such that no material passes from the displacement chamber back into the supply chamber.

This can be achieved in a straightforward manner by the fact that the displacement chamber comprises a displacement spiral and the conveying capacity of the supply screw is matched to the supplied quantity of material.

A variant of embodiment makes provision such that the pulper comprises a mixer disc as a homogenisation disc in the supply chamber and a mixing chamber with a supply screw, wherein the diameter of the displacement spiral is greater than the diameter of the supply screw.

It is advantageous if the pitch of the supply screw is smaller than the pitch of the displacement spiral.

The upper part of the supply screw can then ensure both the homogenisation of the coarse input parts as well as the necessary rotary acceleration for the separation of heavy parts. Insofar as the pulper is operated only at a relatively low speed, the diameter of the screw segment acting as a homogenisation screw is particularly large, whilst its gradient there is selected relatively large. The pulper in the upper region can thus be operated as a thin stock pulper, whilst in the lower region it can be operated as a displacement pulper. The homogenisation screw or disc then acts as a beating disc in a thin stock pulper.

For pulpers of any kind, it is advantageous if a heavy part trap is disposed above the displacement chamber. This can be achieved, for example, by the fact that a thin stock upstream pulper as a mixing chamber without its own beater is positioned on the actual pulper above the displacement chamber.

To produce the heavy part trap, it is proposed that the heavy part trap is disposed radially outside the supply screw. A separate or a lengthened screw with a relatively small conveying capacity then ensures both the necessary centrifugal forces for the effective separation of the heavy parts as well as the material supply into the displacement chamber, for example of a high consistency reactor. The described inverse system—wherein the pulper is upside down—can thus be avoided.

The subject-matter of the invention is also a pulper with a plurality of fibrous material outputs with different hole or slot sizes. Such a pulper does not have to have the other features described above. It is preferably operated as a continuous high consistency pulper. The fibrous material outputs can emerge into separate chambers. The advantage compared to other pulpers of similar design lies in the fact that the input material can be classified into different fractions with different grain sizes. Such a classification can be achieved with only one pulper. A special shaping of the pulper is not necessary.

Figure 2:
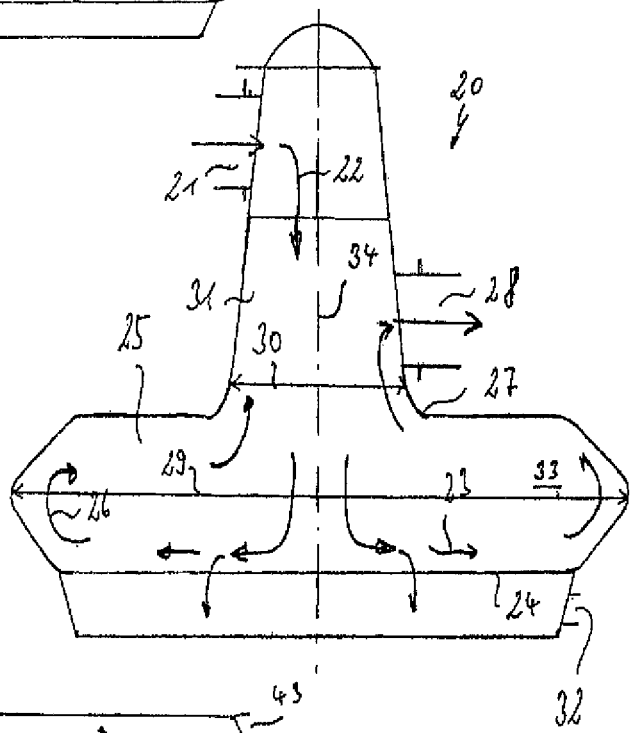
Figure 3:
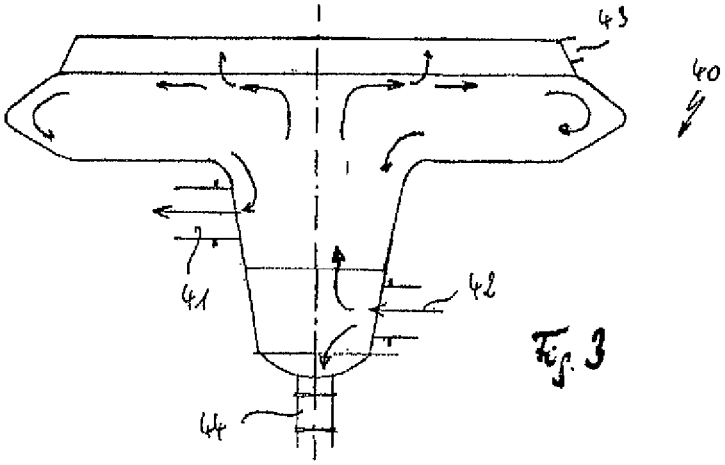
Figure 4:
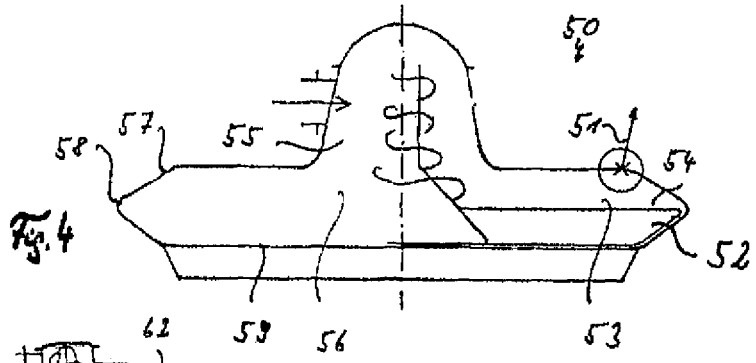
Figure 7:
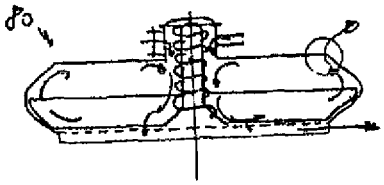
Figure 8:
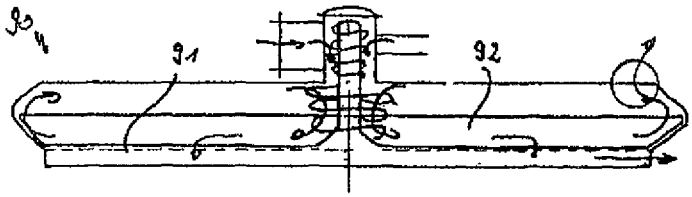
Figure 9:
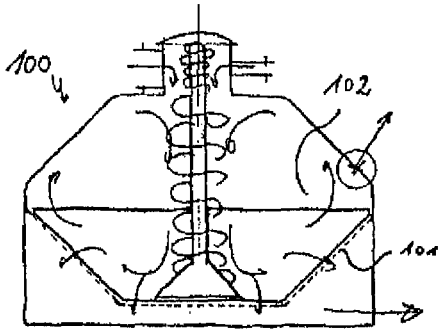
Figure 10:
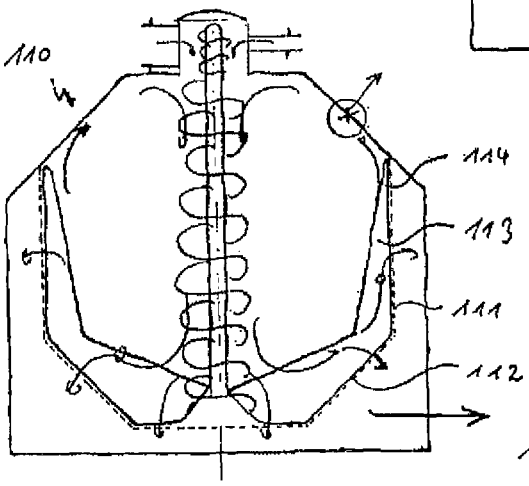
Figure 12:
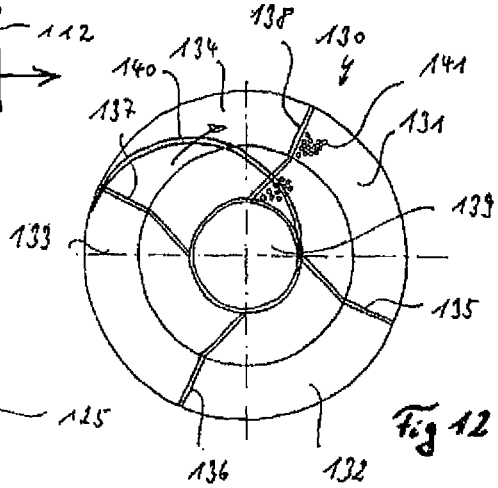
Figure 11:
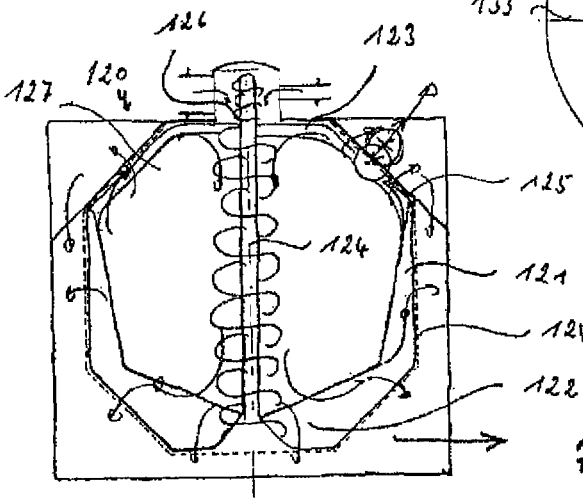
Figure 13:
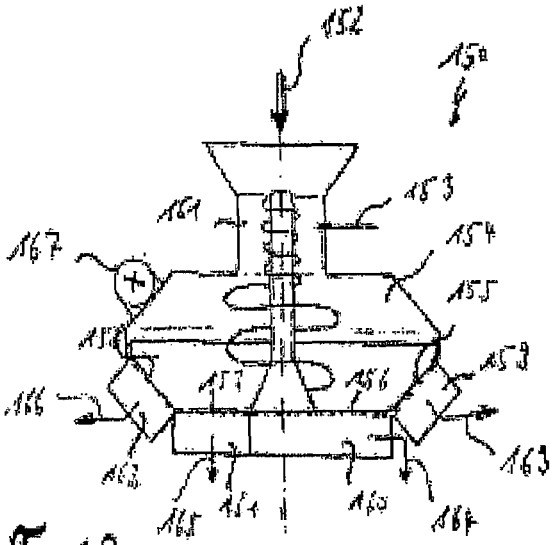
Figure 14:
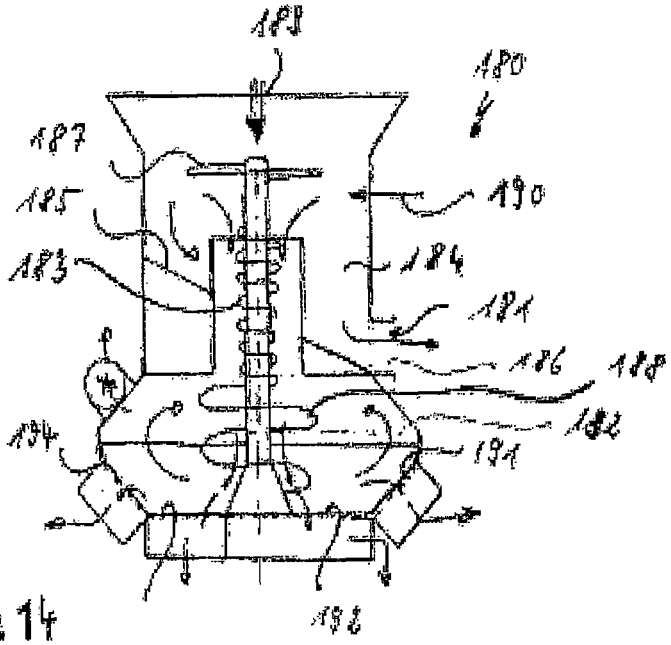
Figure 15:
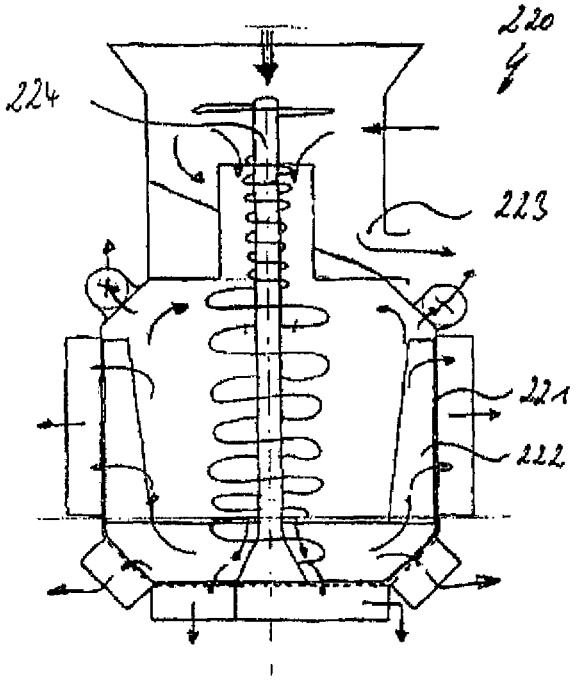

Examples of embodiment of pulpers according to the invention are represented in the drawing and are explained in detail below. In the figures:

FIG. 1 shows dramatically the basic shape of a pulper as a cross-sectional representation, FIG. 2 shows diagrammatically a pulper with a high supply chamber as a cross-sectional representation, FIG. 3 shows diagrammatically a pulper in an inverse arrangement of the supply chamber and displacement chamber as a cross-sectional representation, FIG. 4 shows diagrammatically a pulper with a tangential outlet, FIGS. 5 to 8 show diagrammatically different embodiments of acceleration pulpers, FIGS. 9 and 10 show diagrammatically different embodiments of sleeve pulpers, FIG. 11 shows diagrammatically a pulper with a closed spiral, FIG. 12 shows diagrammatically a pulper base with quasi-grooves, FIG. 13 shows diagrammatically a pulper with a mixing chamber open to the top, FIG. 14 shows diagrammatically a pulper according to FIG. 13 with a heavy part trap, FIG. 15 shows diagrammatically a pulper which has been optimised for used paper treatment.

Pulper 1 shown in FIG. 1 has a supply chamber 2 and a displacement chamber 3. Diameter 4 between supply chamber 2 and displacement chamber 3 is somewhat less in length than ⅓ of maximum diameter 5 of displacement chamber 3. A perforated plate 6 as a screen plate is disposed beneath displacement chamber 3.

The flow in such a pulper is drawn schematically in pulper 20 represented in FIG. 2. Flow 22 is conveyed driven downwards by a supply screw (not shown) from pulper entrance 21, at which the material and water is supplied. There, a displacement spiral (not shown) takes over the subsequent conveyance essentially in a radial direction 23 parallel to screen plate 24. In the radially outer region of displacement chamber 25, flow 26 acts upwards and past neck 27 to waste material outlet 28. A circulation zone 33 thus arises, in which the material supplied to pulper entrance 21 is mixed in above and carried out below. This leads to minimum entropy and the system suspends in a particularly gentle manner, i.e. it produces only a small amount of fines and requires comparatively little current for its operation.

This takes place by the fact that, in the upper part, a screw—not shown here—mixes the material with water and conveys it inwardly downwards along central axis 34. In reaction and circulation zone 33, the material not yet suspended is conveyed outwards and upwards by means of spiral chambers—also not shown here—and is forced there into waste material outlet 28 and drawn out by means of a discharge coil—also not shown.

In this example of embodiment, diameter 29 in displacement chamber 25 is three to four times diameter 30 in supply chamber 31.

The inverse arrangement is provided with pulper 40 shown in FIG. 3. Here, waste material outlet 41 is disposed between pulper entrance 42 and pure material outlet 43. A heavy part outlet 44 is provided beneath pulper entrance 42. Due to the fact that the pulper is upside down, heavy parts are particularly effectively separated.

In both FIGS. 2 and 3, waste material outlet 28 is disposed between pulper entrance 21 and pure material outlet 32.

FIG. 4 shows a pulper body 50 with a tangential outlet 51 and a large spiral 52.

With this pulper, the upper grain size can exit tangentially out of pressure zone 53. Since the circulation process is limited to reaction zone 54, the specific surface of pulper 50 can be kept very small. Material supply chamber 55 is thus minimised and a highly fluid flow takes place through it, without a significant backflow occurring.

The smaller surface of pulper 50 guarantees low surface friction losses and therefore a comparatively small current demand.

Moreover, the removal of the upper grain size is promoted by the pressure prevailing in pressure zone 53.

In addition, so-called rams/banks (large agglomerates)—if any have been formed—are efficiently broken up and separated out.

Furthermore, it can be seen that spiral 52 in reaction chamber 56 is one that has as large a diameter as possible, which leads to suspension that is as gentle as possible. It goes without saying that reactor housing 57 is divided at point 58 of greatest diameter in order to enable the exchange from spiral 52 and perforated plates 59.

FIGS. 5 to 8 shows so-called acceleration pulpers 60, 70, 80 and 90. Characteristic of these acceleration pulpers is the large ratio of diameter to height. The physical mode of operation of the acceleration pulper is based on forcing the suspended parts towards an accelerated evasion before material that is banking up.

Material banks up because the diameter in the inner region of the pulper becomes increasingly small—from the outside inwards—and therefore also the available material passage area. With a smaller area and a constant mass flow, this necessarily leads to a greater speed, paired with acceleration and therefore power consumption. This power finally leads to friction (shearing action) and ultimately to defibration.

The advantages of the tangential output in the region of the pressure zone shown in FIGS. 5 to 8 have already been described in detail above.

Figure 5:
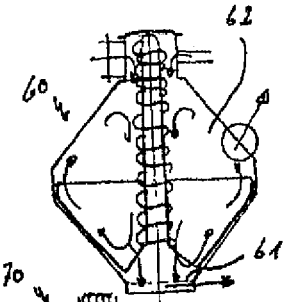

In FIG. 5, the diameter ratio D/H of pulper 60 is equal to 1. Such a pulper 60 is particularly well suited for extremely viscous materials with high defibration resistances, since on the one hand it offers a great deal of space for a blockage-free flow 62 and on the other hand it allows only relatively small material flows on account of the relatively small perforated plate area 61.

Figure 6:
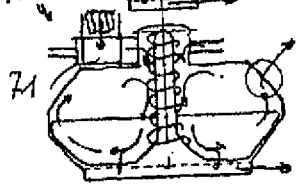

FIG. 6 shows a used paper pulper 70 with a supply lock 71. The diameter ratio stands at approx. 2.3 and represents a compromise between a relatively high freedom from blockage and a relatively large throughput. In order to separate the heavy parts effectively, use can be made of the inverse principle, wherein the pulper, as shown in FIG. 3, essentially lies beneath the perforated plate.

Pulper 80 shown in FIG. 7 has a diameter ratio of 5. It is suitable for free-flowing materials with a low defibration resistance.

FIG. 8 shows a pulper 90 with an extremely large perforated plate area 91. It is intended for the highest throughputs with at the same time both a high and low defibration resistance, provided that the material is free-flowing. The small height guarantees high shearing forces, the large diameter high throughputs. Large spiral 92 leads to intense circulation and the probability is thus reduced that disruptions will occur on account of spontaneous dewatering (thickening or agglomerate formation).

FIGS. 10 and 11 show so-called sleeve pulpers 100 and 110. The principle is shown by FIG. 9: here, perforated plates 101 are also disclosed in the conical transition to upper reaction zone 102. The principle becomes still clearer with the screen basket in FIG. 10. Such a screen basket 111 is known from sorting machines. It leads to outstanding results when used in continuously operated high consistency pulpers.

Holes/slots 112 are kept free here not by "blades", whether rotating or stationary (in the case of a rotating screen basket), but by the "sweeping effect" of the associated materials/paper scraps pushed past holes/slots 112 by displacement spiral 113, as in the case of all continuously operated high consistency pulpers.

The tips of ends 114 of displacement spiral 113 can be formed in the shape of up-draught propellers—not shown here.

Sleeve pulpers are suitable for the highest production quantities with at the same time high defibration resistances, because on the one hand they offer very large open screen areas and on the other hand, on account of the counter-flow, induce great shearing forces outwardly upwards and inwardly downwards using the kappa effect in the presence of speeds that are not too low. The combination with the ball mill effect is advantageous by introducing spheres into the reaction chamber.

A further development of the pulpers shown in FIGS. 9 and 10 leads to pulper 120 shown in FIG. 11 with a closed displacement spiral 121. Here, not only lower end 122 of displacement spiral 121, but also its upper end 123 are connected to a central axis 124.

A closed displacement spiral 121 thus arises. Perforated plates 124, 125 thus made possible also in the upper part of the pulper are also advantageous.

This has the advantage, amongst other things, that displacement spiral 121 acquires a much higher rigidity and the overall design is therefore much less costly. Displacement spiral 121 is thus similar to the stirring element of a kneader of the baking industry—with, however, a completely different purpose. Moreover, displacement spiral 121 ensures that larger agglomerates are already beaten into pieces at the entrance 126 into reactor 127 of pulper 120 and are rapidly homogenised.

Closed spiral 121 of course promotes the circulation and therefore the whole pulper operation.

FIGS. 9, 10 and 11 show how the perforated plate is further developed from a plane area into a tub U-shaped a cross-section and further into a tub C-shaped in cross-section. In FIG. 11, the perforated plate is disposed virtually around the screw or a plurality of perforated plates is placed in a row next to one another in such a way that they surround the screw. Viewed from the screw behind the perforated plate, various chambers can also be provided (not shown), in which different fractions are accommodated.

In FIG. 12, an arrangement 130 of perforated/slotted plate segments 131 to 134 is disclosed in a form in which the distances between them permits a kind of groove 135 to 138 to arise. The pulper contents (associated materials and paper scraps) are pushed by the work of screw 139 and spiral 140 very much better in a first radial, then axial, then again radial and finally axial direction than is the case without grooves. Displacement spiral 140 first pushes pulper contents 141 tangentially, wherein the contents turn aside radially. If the contents arrive at a groove 135 to 138, this reinforces the radial movement.

For production-related reasons, it is advisable to form the pulper base from a plurality of internal perforated plate segments which form a plane surface. These are then followed radially by further perforated plate segments which rise at an angle of approx. 45°. The grooves in the plane then preferably run approximately at right angles to the surface of the displacement spiral and, in the second section of the pulper base, i.e. the first inclined section of the pulper sleeve (cone), at 45°. The optimum would be an angle of 45° both in the plane and in the inclined region between the groove and the displacement spiral, in order to convey the contents efficiently radially outwards and slightly upwards.

Overall, the pulper undergoes an increase in efficiency through this measure, since an intensified circulation with a defibration and washing function occurs and the more harmful rotary motion is limited.

Pulper 150 shown in FIG. 13 is a continuously operated high consistency pulper, which can also be constituted as a displacement pulper or sleeve pulper. This pulper has a mixing chamber 151 open to the top, in which the raw material marked by arrow 152 is mixed with the water indicated by arrow 153. The batch then passes into displacement chamber 154 with screen plates 155 to 158. The fibrous materials pass through these screen plates into different regions 159 to 162 and finally to pure material outlets 163 to 166. The waste material exits from the pulper via waste material outlets 167. Screen plates 155 to 158 of the pulper preferably have different hole and slot sizes.

Pulper 180 in FIG. 14 is designed corresponding to pulper 150 shown in FIG. 13. In addition, however, it has a heavy part trap 181, which is disposed above displacement chamber 182. Heavy part trap 181 lies outside a central supply spiral 183. Central supply screw 183 is disposed in such a way that it generates sufficient radial forces, so that the heavy parts pass into the outer region of a supply chamber 184 and are conveyed there by means of a baffle plate 185 to outlet 186 of heavy part trap 181. Heavy part outlet 186 lies above displacement chamber 182.

Pulper 180 shown in FIG. 14 has on an axis a suspension disc 187, supply screw 183 and a displacement screw 188. Coarse input parts 189 are mixed with introduced water 190 and suspended by means of suspension disc 187. Suspension disc 187 can also be constituted as a beater. Heavy parts are accelerated radially, conveyed via the battle plate and removed from the pulper at outlet 186. The material in the lower region of the pulper is then circulated with displacement screw 188. Via various screen plate regions 191 to 194, fine material is removed out of the pulper into different regions. Through the selection of different screening qualities, different material qualities can also be removed into different regions 191 to 194.

Pulper 220 shown in FIG. 15 is designed as a used paper pulper for continuous operation with a high stock consistency with a relatively low specific defibration resistance. The used paper is rapidly suspended here, so that the free fibrous material has to be rapidly conveyed away in order to prevent blocking of the holes of the screen.

This is achieved by screen basket 221, in which a raised spiral 222 ensures the circulation and thus keeps the holes in screen basket 221 clear by the fact that the associated materials, paper scraps and paper specks are swept by it from the holes of screen basket 221.

A heavy part outfeed 223 is on provided in the upper region of pulper 220, so that the used paper can be supplied from above in the conventional manner.

With this pulper, the volume-related specific defibration capacity is reduced and at the same time the volume-related specific perforated area is greatly increased.

As in the case of the previously shown pulpers, central axis 224 can be positioned above, below or above and below also in the case of pulper 220. This is particularly relevant in the case of a closed design, especially with a mixing chamber and a heavy part trap.

The invention claimed is:

1. A pulper comprising:

a supply chamber;

a displacement chamber, wherein the supply chamber and the displacement chamber form a single container with the supply chamber disposed above the displacement chamber and a diameter between the supply chamber and the displacement chamber amounts at most to ⅓ of a diameter of the displacement chamber;

a shaft extending through the supply chamber and the displacement chamber;

a supply screw coupled to the shaft and disposed in the supply chamber leading centrally to the displacement chamber; and a displacement spiral coupled to the shaft and disposed in the displacement chamber, wherein the supply screw and the displacement spiral are on a same axis.

2. The pulper according to claim 1, wherein a waste material outlet is disposed tangentially to the displacement chamber.

3. The pulper in particular according to claim 1, wherein the supply chamber is open to the top.

4. The pulper according to claim 1, wherein it is constituted such that no material passes from the displacement chamber back into the supply chamber.

5. The pulper in particular according to claim 1, wherein it comprises a mixing disc in the supply chamber.

6. The pulper according to claim 1, wherein a pitch of the supply screw in the supply chamber is smaller than a pitch of the displacement spiral in the displacement chamber.

7. The pulper in particular according to claim 1, wherein a heavy part trap is disposed above the displacement chamber.

8. The pulper according to claim 7, wherein the heavy part trap is disposed radially outside the supply screw.

9. The pulper in particular according to claim 1, wherein it comprises a plurality of fibrous material outlets with different hole or slot sizes.

10. The pulper according to claim 9, wherein the fibrous material outlets emerge into separate chambers.

11. The pulper in particular according to claim 1, wherein it comprises a closed displacement spiral.

12. The pulper in particular according to claim 1, wherein it comprises a basket with openings surrounding the displacement spiral.

13. The pulper in particular according to claim 1, wherein it comprises a lock in the supply chamber.

* * * * *